US005497743A

United States Patent [19]

Clarke

[11] Patent Number: 5,497,743

[45] Date of Patent: Mar. 12, 1996

[54] INJECTOR FOR SEPARATE CONTROL OF FLOW AND MOMENTUM

[75] Inventor: John M. Clarke, Chillicothe, Ill.

[73] Assignee: Caterpillar Inc., Peoria, Ill.

[21] Appl. No.: 364,485

[22] Filed: Dec. 27, 1994

[51] Int. Cl.[6] ..... F02B 3/00

[52] U.S. Cl. ..... 123/294; 123/305

[58] Field of Search ..... 123/294, 295, 123/305, 257; 239/533.12, 533.4, 585

[56] References Cited

U.S. PATENT DOCUMENTS

| | | | |
|---|---|---|---|
| 2,035,203 | 3/1936 | Smith | 299/107.6 |
| 2,114,986 | 4/1938 | Scribner | 299/107.3 |
| 2,629,632 | 2/1953 | Munson | 299/106 |
| 2,860,780 | 11/1958 | Ziesche et al. | 299/107.6 |
| 3,632,047 | 1/1972 | Ghougasian | 239/533 |
| 4,238,075 | 12/1980 | Bauder | 239/533.4 |
| 4,467,965 | 8/1984 | Skinner | 239/464 |
| 4,499,861 | 2/1985 | Wiegand et al. | 123/305 |
| 4,519,547 | 5/1985 | Kubach et al. | 239/585 |
| 4,653,694 | 3/1987 | Noguchi et al. | 239/533.12 |
| 4,867,128 | 9/1989 | Ragg et al. | 123/305 |
| 5,163,621 | 11/1992 | Kato et al. | 239/533.12 |
| 5,329,902 | 7/1994 | Sakamoto et al. | 123/257 |
| 5,392,745 | 2/1995 | Beck | 123/295 |

*Primary Examiner*—Raymond A. Nelli

*Attorney, Agent, or Firm*—Marshall, O'Toole, Gerstein, Murray & Borun

[57] ABSTRACT

A fuel injector includes an injector housing having an inlet and a plurality of discharge orifices. The inlet permits fuel to flow into the injector housing, and the plurality of discharge orifices permit fuel to flow out of the injector housing and into the combustion cylinder. A first variable restriction in the injector housing variably controls the flow of fuel to the plurality of discharge orifices. A second variable restriction in the injector housing variably controls the flow of fuel to the first variable restriction. The first and second variable restrictions independently control momentum and flow rate of the fuel.

30 Claims, 4 Drawing Sheets

FIGURE 1
PRIOR ART
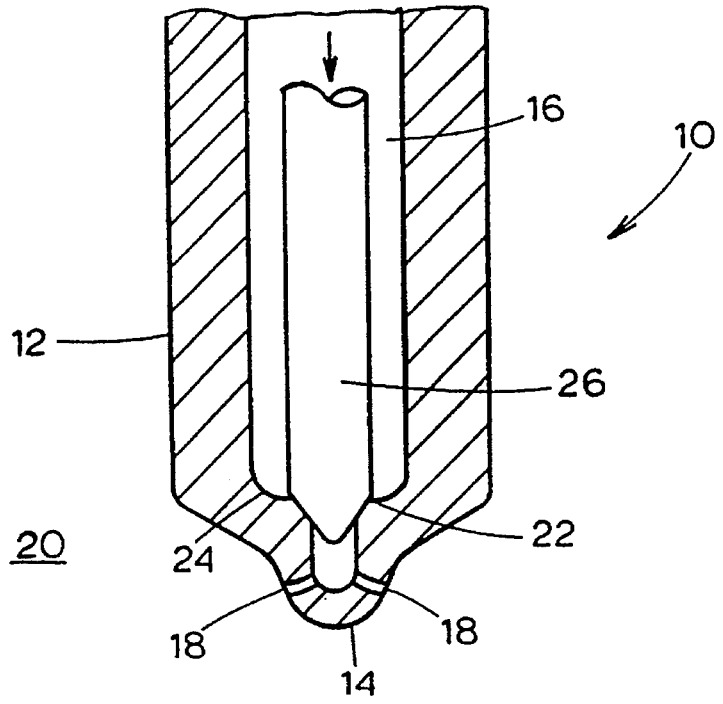
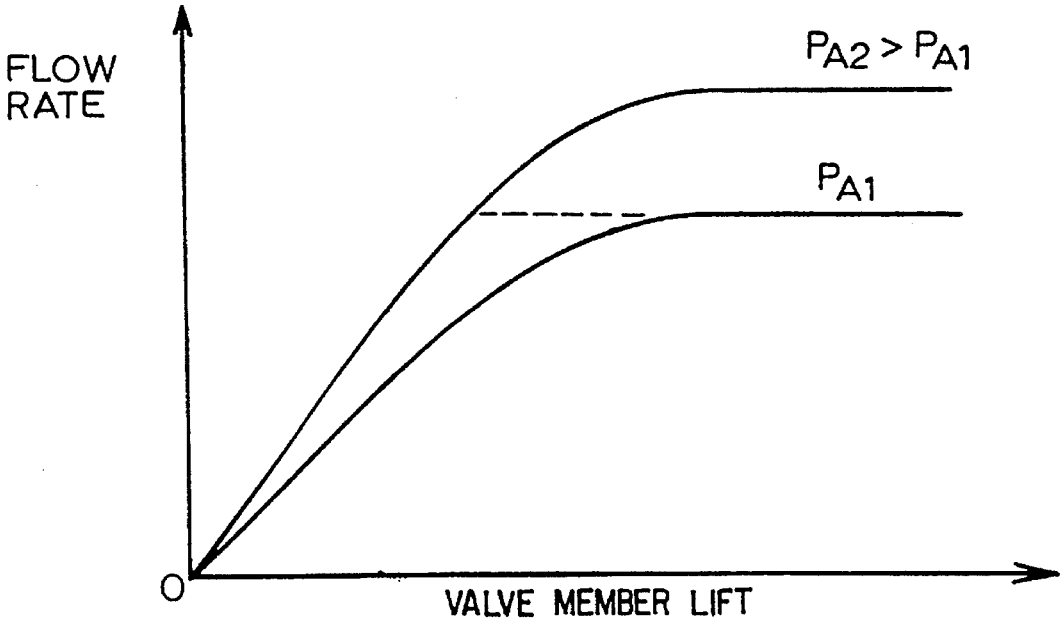
FIGURE 2

FIGURE 3
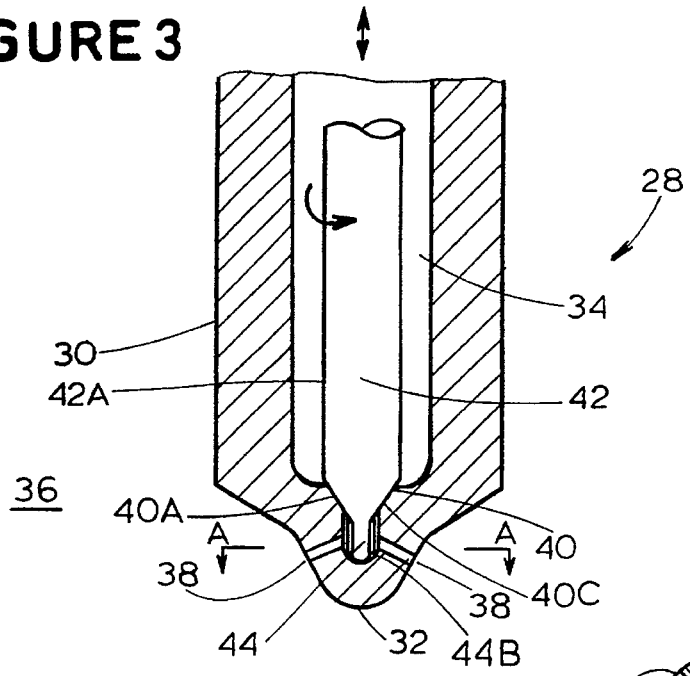
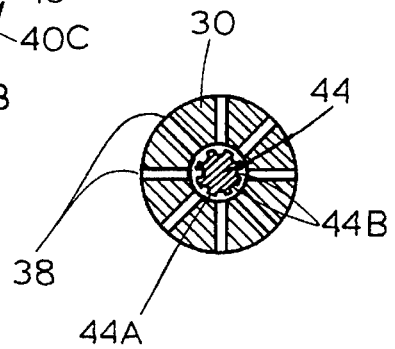
FIGURE 4
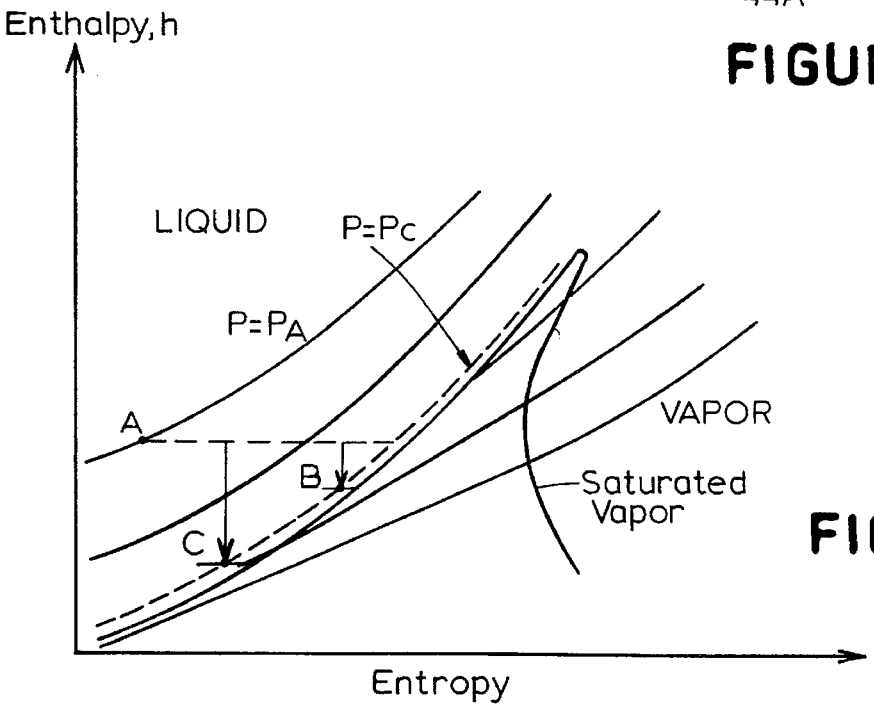
FIGURE 5

INJECTOR FOR SEPARATE CONTROL OF FLOW AND MOMENTUM

TECHNICAL FIELD

The present invention relates to fuel injectors for internal combustion engines such as diesel engines.

BACKGROUND OF THE INVENTION

Fuel injectors for injecting fuel into the combustion cylinders of an internal combustion engine are well known. These fuel injectors must deliver fuel to the combustion cylinders at the right time in the engine cycle and in the right quantity so that the engine operates smoothly at the desired speed. These fuel injectors must also discharge fuel so that the discharged fuel has the proper spray pattern and atomization since both a proper spray pattern and proper atomization are necessary in order to create the proper conditions in the combustion cylinders to assure efficient combustion of the discharged fuel.

If the fuel flow through the fuel injector fluctuates from the desired fuel flow, a proper spray pattern and proper atomization of the fuel are not created. To achieve a proper spray pattern and proper atomization of fuel, the fuel injector is conventionally arranged near the center of the combustion cylinder of the internal combustion engine so that the fuel is sprayed radially from a plurality of nozzle discharge orifices of the fuel injector. Ideally, the flow and momentum of the fuel should be such that the fuel both atomizes in the combustion cylinder and penetrates into the combustion cylinder deeply enough that it adequately mixes with air, which is also supplied to the combustion cylinder, so that efficient burning of the fuel results. If the fuel does have the correct flow and does not penetrate deeply enough, or if the fuel penetrates so deeply that it sprays the opposite end of the combustion cylinder, the fuel will neither atomize properly nor mix with the air properly to result in efficient combustion. Thus, the fuel should have a flow and a momentum vector (i.e. momentum magnitude and momentum direction) to promote the most favorable mixing conditions.

The spray pattern and atomization of the fuel which is discharged into a combustion cylinder is a function of the fuel flow through the fuel injector. Fuel injectors have been provided with the capability of adjusting and regulating the fuel flow through the fuel injectors and the discharge of fuel therefrom. Most of these fuel injectors have a plurality of discharge orifices and at most one internal variable restriction which controls the supply of fuel to the discharge orifices. This variable restriction is typically controlled by fuel pressure. Such a fuel injector cannot, therefore, vary the fuel flow rate to the nozzle discharge orifices while maintaining the fuel pressure constant. Moreover, prior fuel injectors do not allow both the volumetric flow rate and the momentum of the fuel to be independently controlled. Volumetric flow rate (e.g., in $ft^3$ per sec) is the product of velocity of the fuel (e.g., in ft per sec) and the area (e.g., in $ft^2$) through which the fuel flows, and momentum is the product of the mass and velocity of the fuel. Volumetric flow rate is often referred to as flow rate or simply as flow. Since flow and momentum have not been independently controlled by prior fuel injectors, the mixing rate, penetration, fuel break-up, and atomization of the fuel have not been adequate to achieve optimum fuel combustion.

DISCLOSURE OF THE INVENTION

The present invention is directed towards a fuel injector which allows flow and momentum to be independently controlled. In one aspect of the present invention, a fuel injector includes an injector housing and first and second flow controlling means. The injector housing has an inlet and an outlet. The inlet is arranged to permit fuel to flow into the injector housing, and the outlet is arranged to permit fuel to flow out of the injector housing into a combustion chamber. The first flow controlling means controls the flow of fuel between the inlet and the outlet. The second flow controlling means controls the flow of fuel between the inlet and the outlet and cooperates with the first fuel flow controlling means in order to permit momentum and flow rate of the fuel to be independently controlled.

According to another aspect of the invention, a fuel injector includes a discharge orifice and first and second restricting means. The discharge orifice is arranged to be in communication with a combustion chamber in order to discharge fuel into the combustion chamber. The first restricting means variably restricts flow of the fuel through the discharge orifice. The second restricting means variably restricts flow of fuel through the discharge orifice.

According to yet another aspect of the present invention, a fuel injector includes an injector housing, an inlet, a plurality of discharge orifices, and first and second variable restrictions. The inlet is through the injector housing and is arranged to permit fuel to flow into the injector housing. The plurality of discharge orifices are arranged through the injector housing so as to be in communication with a combustion chamber. The plurality of discharge orifices permit fuel to flow out of the injector housing and into the combustion chamber. The first variable restriction is within the injector housing and is arranged to variably control the flow of fuel to the plurality of discharge orifices. The second variable restriction is within the injector housing and is arranged to variably control the flow of fuel to the first variable restriction. The first and second variable restrictions are arranged to cooperate to permit momentum and flow rate of the fuel to be independently controlled.

BRIEF DESCRIPTION OF THE DRAWINGS

These and other features and advantages will become more apparent from a detailed consideration of the invention when taken in conjunction with the drawings in which:

FIG. 1 shows a nozzle of a fuel injector which is arranged to control the flow of fuel into a combustion cylinder through a plurality of discharge orifices;

FIG. 2 is a graph illustrating that the flow rate of the fuel discharged through the discharge orifices of the fuel injector shown in FIG. 1 may be controlled by controlling valve member lift and fuel supply pressure;

FIGS. 3 and 4 taken together illustrate an injector nozzle of a fuel injector having two variable restrictions so that flow rate and momentum of the fuel which is supplied to a combustion cylinder through a plurality of discharge orifices of a fuel injector may be independently controlled;

FIG. 5 is an enthalpy versus entropy graph illustrating the equilibrium properties of a fuel similar to diesel fuel; and, FIGS. 6 and 7 show an example of a control arrangement for controlling the two variable restrictions of the injector nozzle of FIGS. 3 and 4 in order to independently control flow rate and momentum of the fuel injected into a combustion cylinder.

BEST MODE FOR CARRYING OUT THE INVENTION

Figure 6:
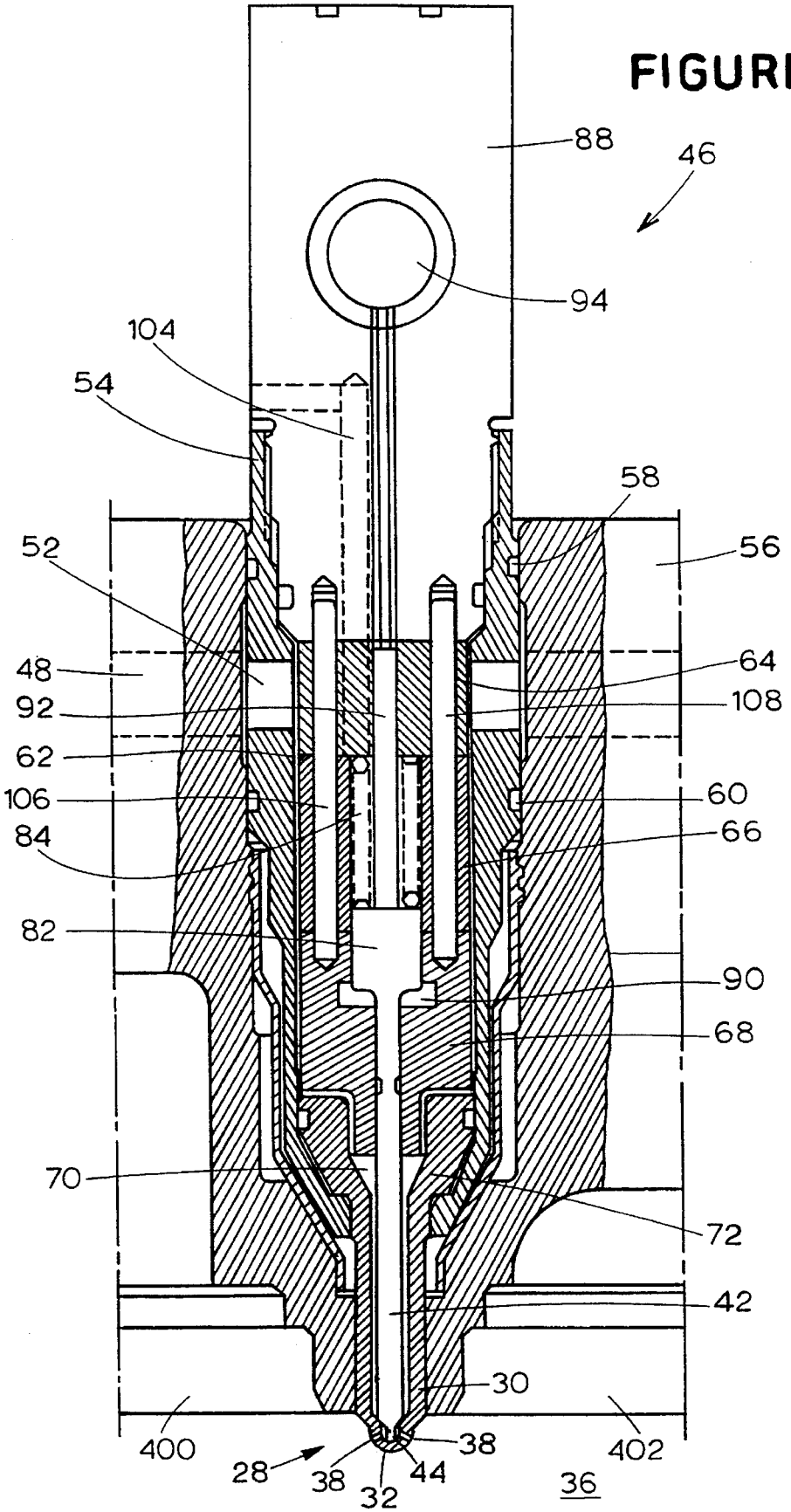

A fuel injector 10 is illustrated in FIG. 1. The fuel injector 10 has an injector nozzle housing 12 and an injector nozzle tip 14 at the end of the injector nozzle housing 12. An injector nozzle interior 16 is confined by the injector nozzle housing 12. A plurality of nozzle discharge orifices 18 extend through the injector nozzle tip 14 between the injector nozzle interior 16 and a combustion cylinder 20.

The fuel injector 10 further has a valve seat 22, which may be circular in shape, and which may be formed around an interior nozzle wall 24 near the injector nozzle tip 14 of the injector nozzle housing 12. The valve seat 22 cooperates with a valve member 26 so that a restriction is formed between the valve member 26 and the valve seat 22. Typically, a spring load biases the valve member 26 against the valve seat 22 in order to seal off any flow of fuel from the injector nozzle interior 16 to the combustion cylinder 20 through the nozzle discharge orifices 18.

Lift is provided to the fuel injector 10 in order to lift the valve member 26 against the spring load and away from the valve seat 22. When the valve member 26 is lifted away from the valve seat 22, fuel can flow from the injector nozzle interior 16, through the nozzle discharge orifices 18, and into the combustion cylinder 20. This lift is typically enough to cause nearly all of the pressure drop through the fuel injector 10 to be across the nozzle discharge orifices 18, i.e., virtually no pressure drop exists across the valve seat 22. By distributing all or most of the pressure drop of the fuel injector 10 across the nozzle discharge orifices 18, the conversion of pressure, i.e. the pressure of the fuel supplied to the fuel injector 10, into momentum, i.e. the momentum of the fuel entering the combustion cylinder 20, is relatively efficient.

The fuel injector 10 may be described as having a fixed geometry. Fuel injection through the fuel injector 10 produces a flow rate, a fuel exit velocity, and fuel exit internal energy dependent only upon fuel supply pressure. Exit internal energy is a function of fuel temperature and the portion of the fuel which may emerge from the discharge orifices in vapor form. Flow rate, fuel exit velocity, and fuel exit internal energy cannot be controlled if the pressure of the fuel supplied to the fuel injector 10 is kept constant.

Thus, according to one aspect of the present invention, the lift of the valve member 26 is controlled, without resort to fuel pressure, so as to variably adjust the restriction between the valve member 26 and the valve seat 22. By variably adjusting the restriction between the valve member 26 and the valve seat 22 without resort to fuel pressure, more advantageous combinations of fuel flow rate and fuel exit internal energy can be attained at the same fuel supply pressure.

For example, by controlling the lift of the valve member 26, the flow characteristics of the fuel injector 10 can be varied. Thus, at low lifts of the valve member 26, the restriction between the valve member 26 and the valve seat 22 is high, whereas at large lifts of the valve member 26, the restriction between the valve member 26 and the valve seat 22 is low. The flow characteristics of the fuel injector 10 can also be varied by varying the pressure of the fuel supplied to the fuel injector 10.

Thus, as shown in FIG. 2, the flow of fuel through the valve seat 22 and through the nozzle discharge orifices 18 may be uniquely defined both by the lift on the valve member 26 and by the fuel supply pressure of the fuel within the injector nozzle interior 16. That is, for a constant fuel supply pressure $P_{A1}$ in the injector nozzle interior 16, the flow rate through the nozzle discharge orifices 18 can be adjusted as a function of lift on the valve member 26. Also, for a constant lift on the valve member 26, the flow rate through the nozzle discharge orifices 18 can be adjusted as a function of fuel pressure. Thus, the relationship between the rate of flow of fuel through the nozzle discharge orifices 18 and lift on the valve member 26 can be adjusted by varying the fuel supply pressure of the fuel within the injector nozzle interior 16.

An injector in which fuel flow therethrough is controlled by a variable restriction provides certain advantages. For example, a fuel injector may be designed to inject alcohol fuel into an engine which is designed to burn either alcohol fuel or diesel fuel. In order to achieve optimum engine performance at rated engine power when alcohol fuel is to be burned by the engine, the size of this fuel injector should be arranged to provide good flow and pressure conditions for alcohol fuel. However, diesel fuel requires both a lower volumetric flow rate through the nozzle discharge orifices of a fuel injector, and a lower injection pressure, than does alcohol fuel. Therefore, unless the fuel injector, which was designed for alcohol, can be controlled so as to provide the ideal volumetric flow rate and injection pressure for diesel fuel, the same fuel injector cannot be ideal for both alcohol fuel and for diesel fuel. As shown in FIG. 2, the fuel injector 10 can be used to inject both alcohol fuel and diesel fuel because the lift on the valve member 26 and the pressure of the fuel in the injector nozzle interior 16 can both be controlled to produce the proper fuel volumetric flow rate and injection pressure for both fuels.

Yet the fuel injector 10 cannot be operated so as to independently control momentum and volumetric flow rate of the fuel flowing through the nozzle discharge orifices 18 into the combustion cylinder 20. Independent control of momentum and volumetric flow rate of a fuel can be achieved by a fuel injector 28, which is shown in FIGS. 3 and 4. The fuel injector 28 has two variable restrictions which permit the volumetric flow rate and momentum of the fuel supplied to a combustion cylinder to be independently controlled.

The fuel injector 28 has an injector nozzle housing 30 and an injector nozzle tip 32 at an end of the injector nozzle housing 30. The injector nozzle housing 30 surrounds an injector nozzle interior 34 which receives fuel to be supplied to a combustion cylinder 36. A plurality of discharge orifices 38 extend through the injector nozzle tip 32 so that fuel within the injector nozzle interior 34 can flow into the combustion cylinder 36.

The fuel injector 28 further has a valve seat 40, which may be circular in shape, and which may be formed around an interior nozzle wall 40A near the injector nozzle tip 32 of the injector nozzle housing 30. The valve seat 40 cooperates with a valve member 42 to form a variable restriction in the fuel injector 36. This variable restriction may be infinitely varied from the point where the valve member 42 engages the valve seat 40 to completely shut off flow through the fuel injector 28 to a point where the valve member 42 is lifted away from the valve seat 40 to permit maximum fuel flow through the fuel injector 28.

The valve member 42 has an outer valve member circumference 42A and a valve member tip 44. The valve member tip 44 is tapered from the outer valve member circumference 42A of the valve member 42 down to a valve member tip circumference 44A. The valve member tip circumference 44A is smallest at the end of the valve member tip 44. The valve member tip 44 has a plurality of slots 44B. The slots 44B form recesses in the surface of the valve member tip 44. The slots 44B follow the taper of the valve member tip 44, and the slots 44B extend from the end of the valve member tip 44 to a valve member tip circumference 44C. The valve member tip circumference 44C is larger than the valve member tip circumference 44A of the valve member tip 44, and the valve member tip circumference 44C is at least somewhat smaller than the circumference of the valve member 42 at the point where the valve member 42 engages the valve seat 40 so that the flow of fuel to the combustion cylinder 36 can be shut off. Accordingly, since the slots 44B do not extend into the area of the valve seat 40, fuel flow through the discharge orifices 38 is prevented when the valve member 42 is seated against the valve seat 40.

Preferably, each of the discharge orifices 38 has a corresponding one of the plurality of slots 44B. The valve member 42 may be rotated so as to align or variably misalign each of the plurality of slots 44B with its corresponding one of the discharge orifices 38. Thus, the slots 44B, in cooperation with the discharge orifices 38, form a variable restriction in the fuel injector 28. The restriction of this variable restriction is least when the slots 44B are aligned with the corresponding discharge orifices 38 and is maximum when the slots 44B are completely misaligned with the corresponding discharge orifices 38.

With this construction, the fuel injector 28 has two variable restrictions. The first of these variable restrictions is formed between the slots 44B of the valve member tip 44 and the plurality of discharge orifices 38 extending through the injector nozzle tip 32. The second of these variable restrictions is formed between the valve member 42 and the valve seat 40. As indicated by the arrows shown in FIG. 3, the variable restrictions provided within the fuel injector 28 may be controlled by controlling the rotation of the valve member 42 with respect to the injector nozzle housing 30 and by controlling the lift exerted on the valve member 42. Thus, the first variable restriction between the slots 44B and the discharge orifices 38 is controlled by the rotation of the valve member 42 with respect to the injector nozzle housing 30, and the second variable restriction between the valve member 42 and the valve seat 40 is controlled by the lift on the valve member 42. Accordingly, the drop in fuel pressure from the pressure of the fuel within the injector nozzle interior 34 to the pressure of the fuel as the fuel is released into the combustion cylinder 36 is shared, as desired, between the first variable restriction between the slots 44B and the discharge orifices 38 and the second variable restriction between the valve seat 40 and the valve member 42.

With this arrangement, exit momentum, which governs the mixing rate and penetration of the fuel in the combustion cylinder 36, and volumetric flow rate, which governs the amount of fuel delivered to the combustion cylinder 36 and atomization, may be independently controlled. That is, the velocity of the fuel emitted into the combustion cylinder 36 through the discharge orifices 38 and the area within the fuel injector 28 through which the fuel flows may be relatively adjusted for best penetration, mixing, and atomization at each level of fuel volume supplied to the combustion cylinder 36. Also, it is possible to control exit momentum relative to exit internal energy for optimum combustion of fuel.

FIG. 5 is an enthalpy versus entropy diagram for the equilibrium properties of a fluid similar to diesel fuel. As an example, the fuel may enter the fuel injector 28 at state A, and the fuel may leave the fuel injector 28 and enter the combustion cylinder 36 from the discharge orifices 38 of the fuel injector 28 at either state B or state C depending upon the efficiency of the flow process in the fuel injector 28, i.e., dependent upon the sizes of the first variable restriction between the slots 44B and the discharge orifices 38 and the second variable restriction between the valve member 42 and the valve seat 40. High exit velocity of the fuel which is discharged into the combustion cylinder 36 corresponds to the distance $h_A-h_C$ and produces high efficiency, while low exit velocity of the fuel which is discharged into the combustion cylinder 36 corresponds to the distance $h_A-h_B$ and produces low efficiency. The energy difference between $h_C$ and $h_B$ takes the form of a difference in fuel temperature and/or atomization between the two states.

Figure 7:
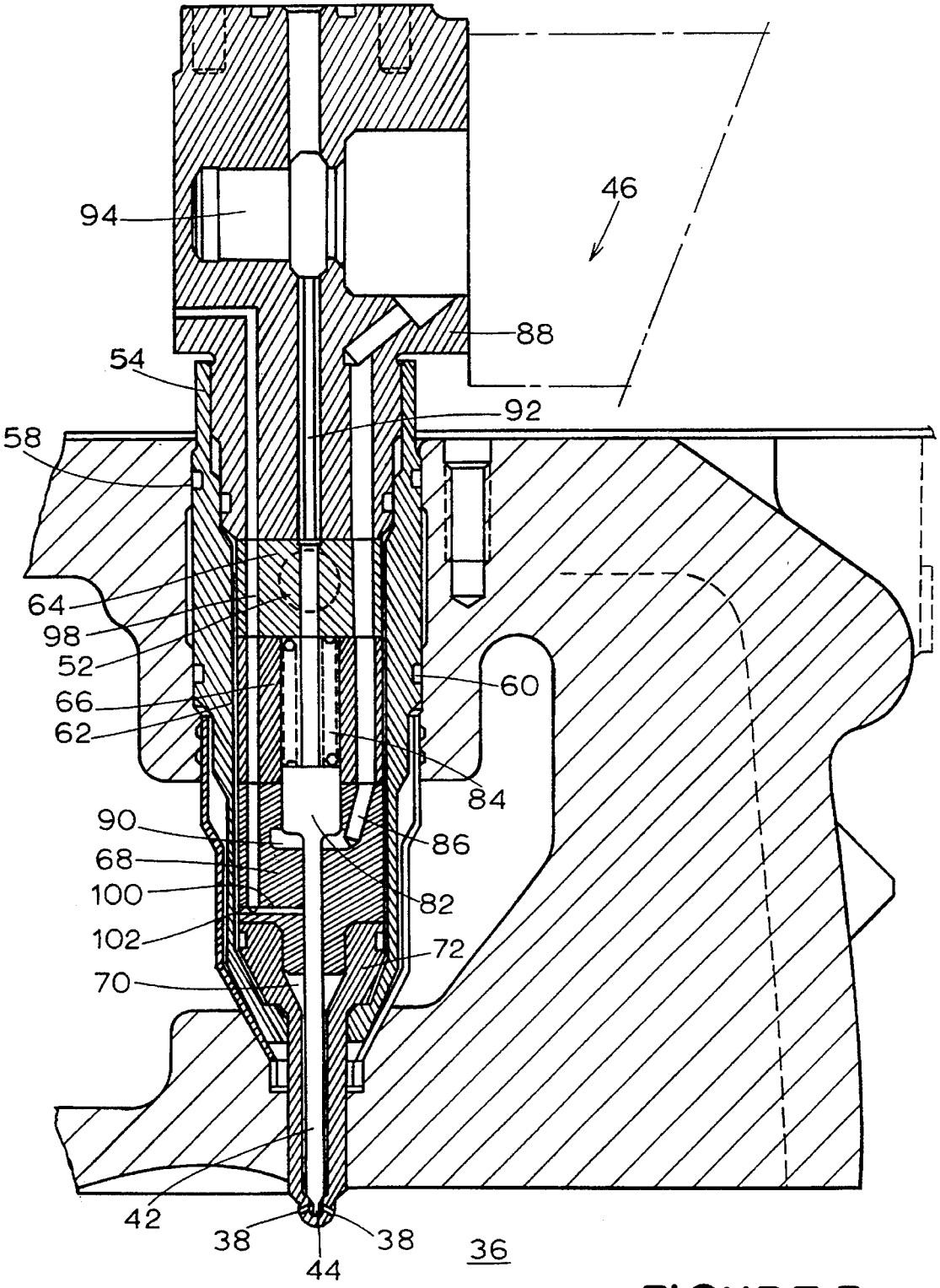

Although any conventional controls may be used to control the lift on, and rotation of, the valve member 42 of the fuel injector 28, one convenient arrangement is shown in FIGS. 6 and 7. As shown in FIG. 6, an injector control system 46 is supplied with fuel through a fuel line 48, and the fuel from the fuel line 48 enters the injector control system 46 through a hole 52 in an injector cone 54 of the injector control system 46. One or more O-rings 58, and one or more O-rings 60, seal the injector cone 54 from a cylinder head 56 in order to prevent fuel from leaking out between the cylinder head 56 and the injector control system 46.

As fuel enters the injector control system 46 through the hole 52, the fuel flows through an annulus 62 which extends along an inner surface of the injector cone 54 between the injector cone 54 and three internal injector components 64, 66, and 68. The fuel flows from the hole 52 through the annulus 62 into an injector fuel chamber 70 formed between an injector nozzle 72 and the internal injector component 68.

As discussed above, the second variable restriction between the valve member 42 and the valve seat 40 of the injector control system 46 is controlled by controlling the position of the valve member 42 with respect to the valve seat 40. The position of the valve member 42 with respect to the valve seat 40 is controlled by controlling a lift piston 82 which may be integrally formed with the valve member 42. A spring 84, which is located in a spring chamber within the internal injector component 66, has one end which abuts the internal injector component 64 and another end which abuts the lift piston 82. Accordingly, the spring 84 biases the lift piston 82 in a direction to close the valve member 42 against the valve seat 40.

As shown in FIG. 7, hydraulic fluid, which may be supplied through by a poppet valve (not shown) under the control of an engine speed controller (not shown), is provided through a passageway 86, which extends through the internal injector components 64, 66, and 68, and through an injector body 88, of the injector control system 46, to a lift chamber 90 beneath the lift piston 82. The hydraulic pressure in the lift chamber 90 applies a force to the lift piston 82 in a direction opposite to the force applied to the lift piston 82 by the spring 84. Accordingly, if the hydraulic pressure within the lift chamber 90 is sufficiently large, the lift piston 82 moves the valve member 42 upward away from the valve seat 40 in order to lower the restriction of the second variable restriction between the valve member 42 and the valve seat 40.

A rotatable pin 92 extends through the injector body 88, through the internal injector component 64, and through the spring chamber in the internal injector component 66. The rotatable pin 92 is suitably attached to the lift piston 82. A motor, such as a stepper motor 94, operates the rotatable pin 92 in response to the engine speed controller in order to rotate the lift piston 82 and the valve member 42 so as to control the first variable restriction between the slots 44B and the discharge orifices 38.

Accordingly, the first variable restriction between the slots 44B and the discharge orifices 38 is controlled by the stepper motor 94, and the second variable restriction between the valve member 42 and the valve seat 40 is controlled by the hydraulic pressure in the lift chamber 90.

High pressure hydraulic fluid is supplied through a passageway 98 formed through the injector body 88 and the internal injector components 64, 66, and 68. A lateral passageway 100 extends between the passageway 98 and the valve member 42. Accordingly, high pressure hydraulic fluid is applied laterally against the valve member 42 to hydraulically isolate the fuel in the injector fuel chamber 70 from the hydraulic fluid in the lift chamber 90. A plug 102 in the lateral passageway 100 isolates the hydraulic fluid in the lateral passageway 100 from the fuel in the annulus 12.

As shown in FIG. 6, the chamber, which is within the internal injector component 66 and which contains the spring 84, is vented by way of a passageway 104 which extends through the injector body 88 and the internal injector component 64. Any hydraulic fluid leaking around the lift piston 82 from the lift chamber 90 to the spring cavity containing the spring 84 may be returned to a hydraulic sump through the passageway 104. A pair of dowels 106 and 108 extend through the injector body 88 and the internal injector components 64, 66, and 68 in order to maintain a constant positional relationship between the internal injector components 64, 66, and 68 with respect to the injector body 88.

INDUSTRIAL APPLICABILITY

When the speed of the engine, which is supplied with fuel by the injector control system 46, is to be changed, the stepper motor 94 and the hydraulic fluid supplied to the lift chamber 90 through the passageway 86 may be changed in accordance with engine timing and as necessary in order to correspondingly adjust the first variable restriction between the slots 44B and the discharge orifices 38 and the second variable restriction between the valve member 42 and the valve seat 40. When the hydraulic fluid supplied to the lift chamber 90 through the passageway 86 is changed, the force applied to the lift piston 82 by the hydraulic pressure in the lift chamber 90 in opposition to the force applied to the lift piston 82 by the spring 84 is also changed. Accordingly, when the hydraulic pressure within the lift chamber 90 is sufficiently large, the lift piston 82 moves the valve member 42 upward away from the valve seat 40 by an amount to meet the speed demands on the engine. Thus, the second variable restriction is adjusted as determined by the force differential across the lift piston 82 in order to control the amount of fuel which is supplied to the first variable restriction between the slots 44B and the discharge orifices 38 is appropriately controlled.

When the stepper motor 94 is changed, the stepper motor 94 rotates the rotatable pin 92, which extends through the injector body 88, through the internal injector component 64, and through the spring chamber in the internal injector component 66. As the rotatable pin 92 rotates, the lift piston 82 and the valve member 42 rotate to adjust the angular position between the slots 44B and the discharge orifices 38. Thus, the first variable restriction is adjusted in order to control the discharge of fuel into the combustion cylinder 36 through the discharge orifices 38.

By so controlling the first and second variable restrictions, the volumetric flow rate and momentum of the fuel which is injected into the combustion cylinder 36 by the injector control system 46 may be controlled in order to achieve proper penetration, mixing, and atomization of the fuel so that the desired engine speed may be attained at optimum efficiency.

Modifications to the present invention will occur to those skilled in the art. For example, instead of using hydraulic pressure as the lift pressure in the lift chamber 90, fuel pressure may be used while still independently varying volumetric flow rate and the momentum of the injected fuel. All such modifications are intended to be within the scope of the present invention.

I claim:

1. A fuel injector comprising:

an injector housing having an inlet and an outlet, wherein the inlet is arranged to permit fuel to flow into the injector housing, and wherein the outlet is arranged to permit fuel to flow out of the injector housing into a combustion cylinder;

first flow controlling means for controlling the flow of fuel between the inlet and the outlet; and, second flow controlling means for controlling the flow of fuel between the inlet and the outlet, and for independently cooperating with the first flow controlling means in order to permit momentum and flow rate of the fuel to be independently controlled.

2. The fuel injector of claim 1 wherein the first flow controlling means comprises slots in the end of a valve member, and wherein the slots are arranged to variably control the flow of fuel to the outlet of the injector housing.

3. The fuel injector of claim 2 wherein the first flow controlling means comprises valve member rotating means for rotating the valve member in order to variably position the slots with respect to the outlet of the injector housing.

4. The fuel injector of claim 2 wherein the second flow controlling means comprises a valve seat cooperating with the valve member in order to control the flow of fuel to the slots.

5. The fuel injector of claim 4 wherein the second flow controlling means comprises valve member lifting means for lifting the valve member with respect to the valve seat in order to control the flow of fuel to the slots.

6. The fuel injector of claim 5 wherein the first flow controlling means comprises valve member rotating means for rotating the valve member in order to variably position the slots with respect to the outlet of the injector housing.

7. The fuel injector of claim 1 wherein the outlet of the injector housing comprises a plurality of discharge orifices.

8. The fuel injector of claim 7 wherein the first flow controlling means comprises slots in the end of a valve member, and wherein the slots are arranged to variably control the flow of fuel to the plurality of discharge orifices.

9. The fuel injector of claim 8 wherein the first flow controlling means comprises valve member rotating means for rotating the valve member in order to variably position the slots with respect to the discharge orifices.

10. The fuel injector of claim 8 wherein the second flow controlling means comprises a valve seat cooperating with the valve member in order to control the flow of fuel to the slots.

11. The fuel injector of claim 10 wherein the second flow controlling means comprises valve member lifting means for lifting the valve member with respect to the valve seat in order to control the flow of fuel to the slots.

12. The fuel injector of claim 11 wherein the first flow controlling means comprises valve member rotating means for rotating the valve member in order to variably position the slots with respect to the plurality of discharge orifices.

13. The fuel injector of claim 1 wherein the second flow controlling means comprises a valve seat cooperating with a valve member in order to control the flow of fuel between the inlet and the outlet.

14. The fuel injector of claim 13 wherein the second flow controlling means comprises valve member lifting means for lifting the valve member with respect to the valve seat in order to control the flow of fuel between the inlet and outlet.

15. A fuel injector comprising:

a discharge orifice which is arranged to be in communication with a combustion cylinder in order to discharge fuel into the combustion cylinder;

first restricting means for variably restricting flow of the fuel through the discharge orifice; and, second restricting means for variably restricting flow of the fuel through the discharge orifice, wherein the first and second restricting means are independently controlled.

16. The fuel injector of claim 15 wherein the first restricting means comprises a slot in the end of a valve member, and wherein the slot is arranged to cooperate with the discharge orifice in order to form a first variable restriction to the flow of fuel.

17. The fuel injector of claim 16 wherein the first restricting means comprises valve member rotating means for rotating the valve member in order to variably control the first variable restriction.

18. The fuel injector of claim 16 wherein the second restricting means comprises a valve seat cooperating with the valve member in order to form a second variable restriction to the flow of fuel.

19. The fuel injector of claim 18 wherein the second restricting means comprises valve member lifting means for lifting the valve member with respect to the valve seat in order to variably control the second variable restriction.

20. The fuel injector of claim 19 wherein the first restricting means comprises valve member rotating means for rotating the valve member in order to variably control the first variable restriction.

21. The fuel injector of claim 15 wherein the second restricting means comprises a valve seat cooperating with a valve member in order to form a variable restriction to the flow of fuel.

22. The fuel injector of claim 21 wherein the second restricting means comprises valve member lifting means for lifting the valve member with respect to the valve seat in order to variably control the variable restriction.

23. A fuel injector comprising:

an injector housing;

an inlet through the injector housing, wherein the inlet is arranged to permit fuel to flow into the injector housing;

a plurality of discharge orifices through the injector housing, wherein the plurality of discharge orifices are arranged to be in communication with a combustion cylinder so as to permit the fuel to flow out of the injector housing and into the combustion cylinder;

a first variable restriction within the injector housing, wherein the first variable restriction is arranged to variably control the flow of fuel to the plurality of discharge orifices; and, a second variable restriction within the injector housing, wherein the second variable restriction is arranged to variably control the flow of fuel to the first variable restriction, and wherein the first and second variable restrictions are arranged to independently cooperate to permit momentum and flow rate of the fuel to be independently controlled.

24. The fuel injector of claim 23 wherein the first variable restriction comprises a plurality of slots in the end of a valve member, and wherein the plurality of slots are arranged to cooperate with the plurality of discharge orifices in order to form the first variable restriction.

25. The fuel injector of claim 24 wherein the first variable restriction comprises valve member rotating means for rotating the valve member in order to variably position the plurality of slots with respect to the plurality of discharge orifices so as to variably control the first variable restriction.

26. The fuel injector of claim 24 wherein the second variable restriction comprises a valve seat cooperating with the valve member in order to form the second variable restriction, and wherein the valve seat is located upstream of the slots.

27. The fuel injector of claim 26 wherein the second variable restriction comprises valve member lifting means for lifting the valve member with respect to the valve seat in order to variably control a distance between the valve member and the valve seat so as to variably control the second variable restriction.

28. The fuel injector of claim 27 wherein the first variable restriction comprises valve member rotating means for rotating the valve member in order to variably position the plurality of slots with respect to the plurality of discharge orifices so as to variably control the first variable restriction.

29. The fuel injector of claim 23 wherein the second variable restriction comprises a valve seat cooperating with a valve member in order to form the second variable restriction, and wherein the valve seat is located upstream of the first variable restriction.

30. The fuel injector of claim 29 wherein the second variable restriction comprises valve member lifting means for lifting the valve member with respect to the valve seat in order to variably control a distance between the valve member and the valve seat so as to variably control the second variable restriction.

* * * * *